US007340987B1

(12) United States Patent
Williams

(10) Patent No.: US 7,340,987 B1
(45) Date of Patent: Mar. 11, 2008

(54) CONVERSION PLATFORM FOR A .45 ACP PISTOL

(75) Inventor: Charles David Williams, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 11/252,307

(22) Filed: Oct. 17, 2005

(51) Int. Cl.
*F41A 3/64* (2006.01)
*F41C 27/00* (2006.01)

(52) U.S. Cl. ..... 89/196; 89/29; 42/15

(58) Field of Classification Search ..... 89/196, 89/29, 163, 194; 42/15, 77
See application file for complete search history.

(56) References Cited

U.S. PATENT DOCUMENTS

| | | | | | |
|---|---|---|---|---|---|
| 1,401,152 | A | * | 12/1921 | Green | 42/50 |
| 1,517,483 | A | * | 12/1924 | Young | 89/183 |
| 2,543,604 | A | * | 2/1951 | Singer | 42/16 |
| 4,539,889 | A | | 9/1985 | Glock | 89/147 |
| 4,651,432 | A | | 3/1987 | Bornancini | 33/233 |
| 4,825,744 | A | | 5/1989 | Glock | 89/145 |
| 4,893,546 | A | | 1/1990 | Glock | 89/145 |
| 5,195,226 | A | | 3/1993 | Bornancini | 29/1.1 |
| 5,228,887 | A | * | 7/1993 | Mayer | 42/75.02 |
| 5,485,695 | A | | 1/1996 | Glock | 42/103 |
| 5,726,377 | A | * | 3/1998 | Harris et al. | 89/191.01 |
| 5,808,229 | A | * | 9/1998 | Bastian et al. | 89/163 |
| 5,827,992 | A | * | 10/1998 | Harris et al. | 89/191.01 |
| 5,857,279 | A | | 1/1999 | DeOliveira Masina | 42/71.01 |
| 5,983,773 | A | * | 11/1999 | Dionne | 89/29 |
| 6,212,991 | B1 | * | 4/2001 | Frazier, III | 89/196 |
| 6,256,915 | B1 | | 7/2001 | Da Silveira | 42/1.05 |
| 6,442,882 | B1 | * | 9/2002 | Dionne | 42/77 |
| 6,550,174 | B2 | * | 4/2003 | Jamison | 42/25 |
| 6,557,287 | B2 | | 5/2003 | Wollmann | 42/50 |
| 7,055,422 | B1 | * | 6/2006 | Dindl et al. | 89/194 |

FOREIGN PATENT DOCUMENTS

WO WO 2004/068061 A1 8/2004

* cited by examiner

*Primary Examiner*—Bret Hayes
(74) *Attorney, Agent, or Firm*—Woodard, Emhardt, Moriarty, McNett & Henry LLP

(57) ABSTRACT

A method of modifying a .45 ACP pistol having a slide and a receiver defining a magazine well includes the steps of reducing the size of the magazine well and shortening the slide. The slide includes a breech face and a proximal end and the magazine well includes a front wall and spaced therefrom a rear wall. Reducing the size of the magazine well involves moving the rear wall closer to the front wall. Shortening the slide involves removing material from between the breech face and the proximal end. The shortening of the slide generally corresponds to the size reduction of the magazine well.

18 Claims, 7 Drawing Sheets

CONVERSION PLATFORM FOR A .45 ACP PISTOL

BACKGROUND OF THE INVENTION

The present invention relates in general to the sizing of pistols relative to the ammunition to be fired and the fit and feel of the pistol for the shooter (i.e., end user). More specifically, the present invention relates to the resizing of the platform for a .45 ACP pistol, such as a Model 1911 pistol, to accept shorter ammunition, such as 9 mm, .357 Sig, 40 S & W, and the newer .45 GAP (Glock® Automatic Pistol) cartridge, to name a few. As described in the published article entitled "Shrinking The GAP" found in the May 2005 issue of *American Rifleman*, Glock developed the .45 GAP cartridge with the intent to create a pistol the size of a high-capacity 9 mm or .40 S & W with the performance of a .45 ACP. The .45 GAP cartridge is a rimless round that propels .45-cal. bullets ranging in weight from 185 to 230 grams. Those bullets are driven at the same velocities as the .45 ACP rounds.

The present invention is directed to resizing (conversion) of the platform for a .45 ACP pistol, such as an M-1911 platform. The objective is to convert the .45 ACP platform such that it is designed specifically for the smaller (shorter) "family" of ammunition that includes, as some of the possibilities, 9 mm, .357 Sig, .40 S & W, and .45 GAP cartridges, with consideration given to the needs of the shooter. Due to the attention being given to the newer .45 GAP cartridge, that style of ammo is selected for the description of the preferred embodiment of this invention. The M-1911 pistol is selected as the style of .45 ACP pistol to explain the present invention. However, the same types of design changes and modifications described for a current M-1911 pistol can be made, according to this invention, to other .45 ACP pistols. These design changes and modifications are also suitable for the other (shorter) cartridges that are defined herein as being a part of this shorter "family". Considering the change in cartridge size (length) between a .45 ACP cartridge and these shorter cartridges, dimensional changes to the M-1911 pistol (or another .45 ACP pistol) have to be considered.

As the referenced magazine article describes, it would have been an option, in lieu of the present invention, to select a regular Model 1911-style pistol and use a blocked magazine to accommodate the shorter .45 GAP cartridge. However, this would have accomplished nothing in terms of overall pistol improvements for the shooters. Arguably, there is no reason for the .45 GAP cartridge to have been developed except to be able to provide .45 ACP performance in a small-frame pistol. The aforementioned article continues to explain that many shooters do not have hands big enough to handle double-wide magazine .45 pistols, and a lesser number cannot easily manage a single-column pistol in the classic M-1911 configuration. A pistol "properly" scaled for the .45 GAP cartridge length puts .45 power in the hands of shooters who otherwise might not have it. Similar sizing benefits are provided for the other ammo in this shorter cartridge family, according to the present invention.

The challenge is how to properly scale (downsize) a current or classic .45 ACP pistol, such as the referenced M-1911 pistol. Questions such as what dimensions should be reduced and how much of a size reduction is appropriate need to be considered. These questions and the related design challenges are addressed by the present invention. Once the appropriate size reductions for the .45 GAP cartridge, and for other cartridges that would be part of this (shorter) family, are determined, the next question is what dimension should be used and where in the component parts of the M-1911 pistol should the dimensional reductions occur. A further consideration, and something addressed by the present invention, is whether certain design efficiencies can result from the downsizing. One example of a contemplated design efficiency is whether a single receiver can be designed in a manner that would accept a plurality of different cartridge sizes, even if other parts, such as the barrel, have to be uniquely sized to the specific (single) cartridge.

The present invention addresses these issues and questions in a novel and unobvious manner. The resultant pistol, according to the present invention, is smaller and fits the hand of the shooter a little better. The size reduction involves a dimensional downsizing of approximately one-eighth of an inch. Everything normally found on the rear of the pistol is moved approximately one-eighth of an inch forward. This affects the main spring housing, grip, safety, and hammer. In effect, the differences in overall length between the .45 ACP cartridge and the shorter cartridges are calculated and a compromise dimension is selected, roughly midway between the range of cartridge length differences for the family of cartridges to be covered. The frame, slide, and magazine are shortened by approximately that compromise dimensional amount, approximately one-eighth of an inch. The magazine well has a fore and aft dimension that becomes shorter by about the same measurement in order to accept the different (smaller) magazine that takes the shorter cartridges, including the .45 GAP cartridge.

The aforementioned article describes the pistol embodiment disclosed herein as being similar to taking a slice down through a .45 ACP pistol and then putting the two pieces back together. One key though is where to take out the material and how to gain other benefits or improvements in the process of downsizing or scaling down the former M-1911 pistol for shorter cartridges, such as the .45 GAP cartridge. The present invention includes a unique and unobvious material removal decision that results in an improvement in terms of overall pistol performance. In terms of describing the present invention, the references to a "shorter" cartridge are intended to cover any cartridge that is shorter in length than the .45 ACP cartridge that is the designated cartridge for the .45 ACP pistol, such as the predecessor M-1911 pistol. Some of the "shorter" cartridges that satisfy this definition include 9 mm, 0.357 Sig, .40 S & W, and .45 GAP. This listing of shorter cartridges is not intended to preclude the applicability of the present invention to any cartridge whose length is less than a .45 ACP cartridge. Another aspect of the present invention is whether a compromise dimension is available that would downsize the M-1911 in a way that would permit the same receiver to handle different magazines for different cartridges in this "shorter" family. A still further aspect of the present invention is where or how to take up the dimensional reduction in the spacing between the fore and aft walls of the magazine well. Ideally, as the distance of separation between the walls of the magazine well is reduced, any dimensional changes to other parts should be made in a manner that will affect the fewest number of other parts.

BRIEF SUMMARY OF THE INVENTION

A method of modifying a .45 ACP pistol for accepting a shorter cartridge according to one embodiment of the present invention comprises a material removal decision for the slice that is taken out behind the breech face. Considering an M-1911 pistol as one example of the type of .45 ACP pistol covered by the present invention, its construction includes a slide and a receiver that defines a magazine well, the slide is configured with a breech face and a proximal end. The magazine well includes a front wall and spaced therefrom a rear wall. One of the method steps involves reducing the distance of separation between the front wall and the rear wall of the magazine well. A second step to this method involves reducing the distance between the breech face and the proximal end of the slide by an amount that is approximately the same as the reduction between the front wall and rear wall of the magazine well.

One object of the present invention is to provide an improved method of downsizing a .45 ACP pistol in order for it to accept shorter cartridges.

Related objects and advantages of the present invention will be apparent from the following description.

DETAILED DESCRIPTION OF THE INVENTION

Figure 1:
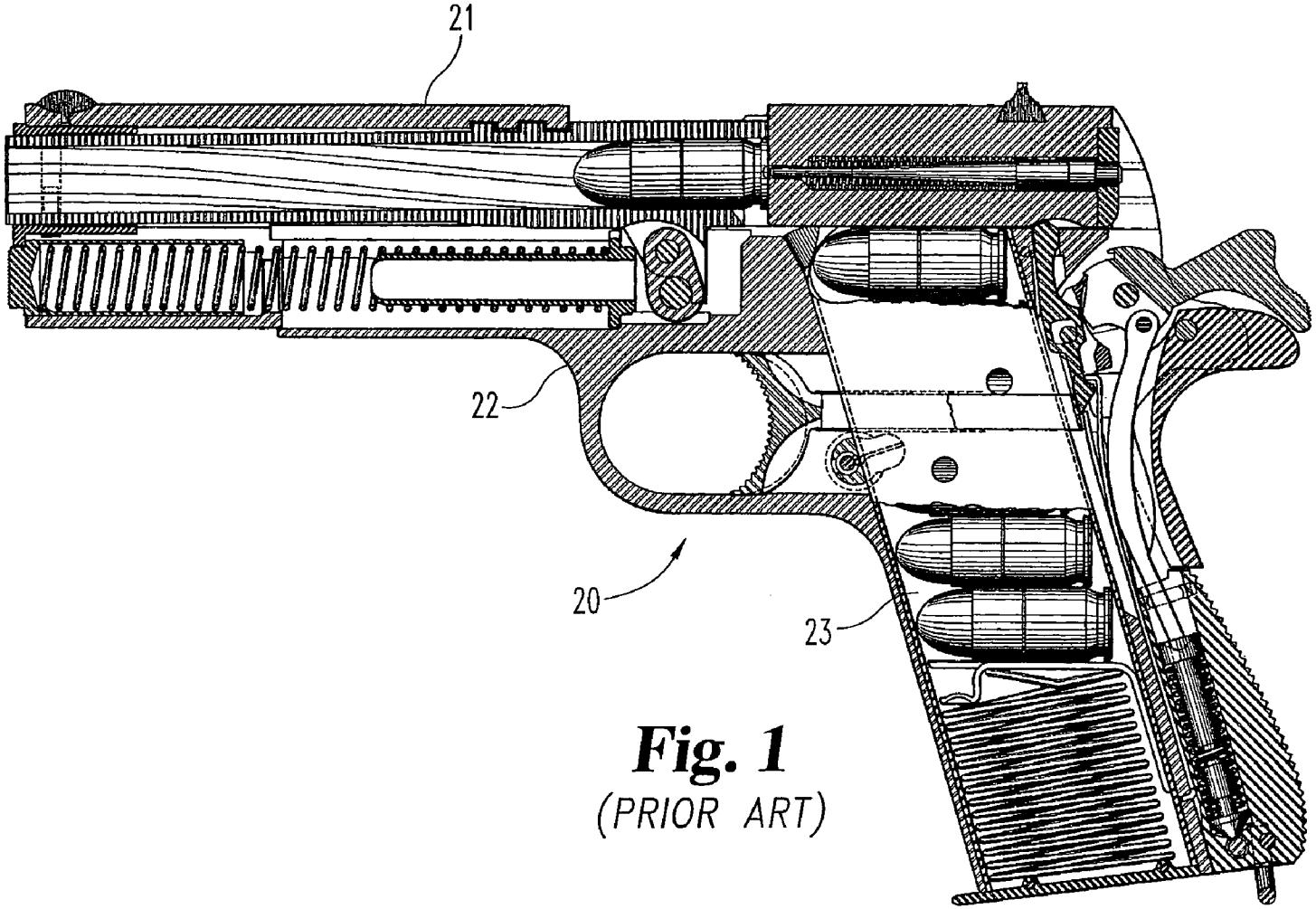
Fig. 1 (PRIOR ART)
FIG. 1 is a side elevational view, in full section, of a predecessor M-1911 pistol.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention is directed to dimensionally changing a .45 ACP platform or pistol so that it is downsized and capable of accepting one of the family of shorter cartridges that includes the .45 GAP, 9 mm, .367 Sig, and .40 S & W. While these are the most likely shorter cartridges to be used at the present time in the modified or converted .45 ACP platform, any cartridge that is shorter than the .45 ACP cartridge is a possible candidate for the present invention.

In order to describe this invention in more specific terms, an M-1911 pistol has been selected. In terms of a specific cartridge for describing the present invention, a .45 GAP has been selected and is the focus of the preferred embodiment. Even though an M-1911 pistol has been selected, the invention is more broadly applicable to any .45 ACP platform. Likewise, while the dimensional downsizing is discussed in terms of the .45 GAP cartridge, and in terms of the other three cartridges within the referenced "family", any cartridge of the described shorter construction is likely suitable for use in the modified pistol, consistent with the downsizing according to the present invention.

The family of shorter cartridges is a consideration as part of the present invention in view of the fact that each one of the four cartridge types listed have a length dimension that is shorter than the length dimension of a .45 ACP cartridge. These shorter length dimensions relative to the .45 ACP cartridge range from being approximately 0.106 inches shorter to being approximately 0.140 inches shorter. Although the corresponding magazines would in all likelihood be sized specifically to the precise cartridge length, the magazine well defined by the receiver or frame incorporates a modest clearance between the exterior surface of the magazine and the front and rear walls of the magazine well. By selecting a mid-range dimensional value between the extremes of 0.106 and 0.140, it is possible, according to the present invention, to define a "universal" magazine well that is suitable for receiving each of the four different magazines that would be sized for each of the four cartridges within the referenced family. Simply taking a mid-point value between the extremes yields a mid-range value for the dimensional modification of approximately one-eighth of an inch, specifically, 0.123 inches. By using this mid-range value for the size reduction to the magazine well, as described herein, the same frame or receiver is able to be used for any of the four shorter cartridges, as described above. Further, it is believed that the same frame or receiver is able to be used, according to the present invention, for any "shorter" cartridge whose length difference, compared to the length of a .45 ACP cartridge, falls within the range of between 0.106 inches shorter and 0.140 inches shorter.

Referring to FIG. 1, there is illustrated a model 1911 pistol 20 that represents or depicts a representative .45 ACP platform that is to be modified according to the present invention in order to accept a shorter cartridge, compared to a .45 ACP cartridge, such as a .45 GAP cartridge. As noted, while the preferred embodiment, as described herein, refers to the .45 GAP cartridge, the downsizing of the illustrated M-1911 pistol can be accomplished for any of the ammo in the referenced "shorter" family. This family includes those cartridges that are shorter in length than the .45 ACP cartridge. It is believed that the construction of the M-1911 pistol is well known to those of ordinary skill in the art. As such, only a few of the component parts are specifically identified herein and only a few of the component parts actually need to be identified in terms of an understanding of the present invention. This more limited itemization of the component parts is simply an aid to help orient pistol 20 and its status or stages in terms of the component parts and the cycle of firing a round, ejecting the spent casing, and chambering a new round. Specifically identified in FIG. 1, as some of the primary component parts of pistol 20, are slide 21, receiver 22, and magazine 23.

The FIG. 1 M-1911 pistol 20 is designed for .45 ACP ammunition and this particular combination has been the preferred choice in terms of stopping power. Some of this comes from the fact that the .45 ACP cartridge is one of the few handgun cartridges that was specifically designed for combat. Like the M-1911 pistol for which it was originally created, the .45 ACP cartridge has become known for its superior performance. The accuracy, adaptability to a variety of missions and purposes and for self-defense functions, including its stopping power, creates a popular pistol and cartridge combination. Now comes the .45 GAP cartridge.

In the 1990's, some of the pistols that would accept the .45 ACP cartridge were rather large pistols and, as a result, less concealable and not as user friendly, especially to those shooters with average or smaller hands. During the late 1990's and early 2000's, new pistol designs and redesigns continued to evolve in an on-going effort to appeal to a wide range of shooters with different preferences.

During this same time period of design evolution, Glock introduced the .45 GAP cartridge which was designed as a slightly shorter cartridge compared to its predecessor, the .45 ACP cartridge. It was felt that the .45 GAP cartridge would offer better functional reliability than the .45 ACP cartridge and yet duplicate its performance. The specifics of the .45 GAP cartridge in terms of size, shape, construction, and bullet weight are believed to be well known and appear to be well documented in the available literature.

The present invention is directed to taking advantage of the slightly shorter .45 GAP cartridge as compared to the .45 ACP cartridge in pursuit of a pistol that is more suitable or user friendly for shooters with average to smaller hands without sacrificing .45 power. In pursuit of a properly scaled pistol for the .45 GAP cartridge, other improvements were pursued and are described herein. The present invention is constructed and arranged to enable the modified (down-sized).45 ACP platform to accept other cartridges that are shorter than the .45 ACP cartridge.

Referring to FIGS. 2-6, it will be assumed that the design changes and platform modification according to the present invention have been introduced into pistol 20 now identified as modified pistol 20*a*. One design change for the new M-1911 pistol 20*a*, according to the present invention, is a resized magazine 23*a*. One design option would have been to simply insert a spacer in the prior art magazine against rear wall 32 and retain the same magazine well 34 in terms of its size and shape. By shrinking the magazine 23 so as to make the front wall 33-to-rear wall 32 horizontal length shorter and sized specifically for the .45 GAP cartridge, the cooperating magazine well 34 defined by receiver 22*a* is able to be made smaller and this is reflected as part of M-1911 pistol 20*a*. This improvement would not have resulted by simply blocking the magazine in order to make the clearance space between the front and rear walls shorter. The distance of separation between the rear wall 32 and front wall 33 of magazine 23*a* is set to conform to and to accommodate the length of the .45 GAP cartridge.

The initial grouping or family of shorter cartridges that were considered for the present invention include the .45 GAP, 9 mm, .357 Sig, and .40 S & W. While other cartridges may be part of this family, the key is whether the length difference relative to a .45 ACP cartridge falls within the determined range. Considering the nominal lengths of these four cartridges relative to the nominal length of a .45 ACP cartridge, the length differences range from 0.106 inches to 0.140 inches. These specific cartridges have the following listed nominal lengths, resulting in this length difference range.

| Cartridge Style | Nominal Cartridge Length |
|---|---|
| .45 ACP | 1.275 inches |
| .45 GAP | 1.137 inches |
| 9 mm | 1.169 inches |
| .357 Sig | 1.135 inches |
| .40 S & W | 1.140 inches |

For the present invention, it was envisioned that a mid-range value of 0.123 inches, approximately one-eighth of an inch, for the size reduction for the pistol would result in a downsized magazine well 34 that would still accept a properly-sized magazine for each of these different cartridges, without having to change the receiver or frame. In terms of moving the front wall 34*a* and/or the rear wall 34*b* of the defined magazine well 34 in order to make the 0.123 inch reduction in the distance between these walls, the intent was to move the walls in a manner that would minimize the need to change other component parts of the pistol.

Due to the angle of incline of the front wall 33 and rear wall 32 of the magazine 23*a*, any measurement of the "distance" of separation of these two walls must be qualified. There is a measurement that can be taken normal to the wall surfaces. There is another, longer measurement that is taken on a horizontal plane, based upon the orientation of the pistol 20 in FIG. 1. Since the .45 GAP cartridge is horizontal as loaded into the magazine 23*a*, the dimensional changes discussed herein are based on using this same horizontal orientation or horizontal plane for any dimensional measurements or references. The same convention is applicable to magazine well 34.

The design modification to the original (full-size) magazine in order to create the downsized magazine 23*a* can best be described as taking a length-wise slice of material out of the magazine and pushing the magazine rear wall 32 towards the magazine front wall 33. The "slice" of material in front-to-rear width depends on the cartridge length difference between the selected cartridge and a .45 ACP cartridge. For the magazine well, a mid-range slice dimension of approximately one-eighth inch (0.123 inches) is selected. Due to the cooperation and interdependence between the pistol component parts, other dimensional adjustments or modifications have to be made. In effect, the main spring housing 37, grip safety 38, and hammer 39 are moved approximately one-eighth inch (0.123 inches) forward. Further, the extractor 40, firing pin 41, and firing pin spring 42 are shorter, as is the trigger 43. In terms of M-1911 operation, cartridge feeding takes place when a round or cartridge 46 in the magazine 23*a* is moved forward into the path of the slide 21*a* by the magazine follower 48 and magazine spring 49. As this occurs, there is a cartridge ramping action that occurs as the slide 21*a* moves forward and begins to strip and thereby feed a round 46 forward from the magazine 23*a*. Chambering occurs when a new round 46 is fed from the magazine 23*a* and placed in the chamber 50. This action occurs as the slide 21*a* moves forward under compressed recoil spring pressure. A cartridge 46 is stripped from the magazine and pushed up the frame/barrel ramp and into chamber 50.

Figure 2:
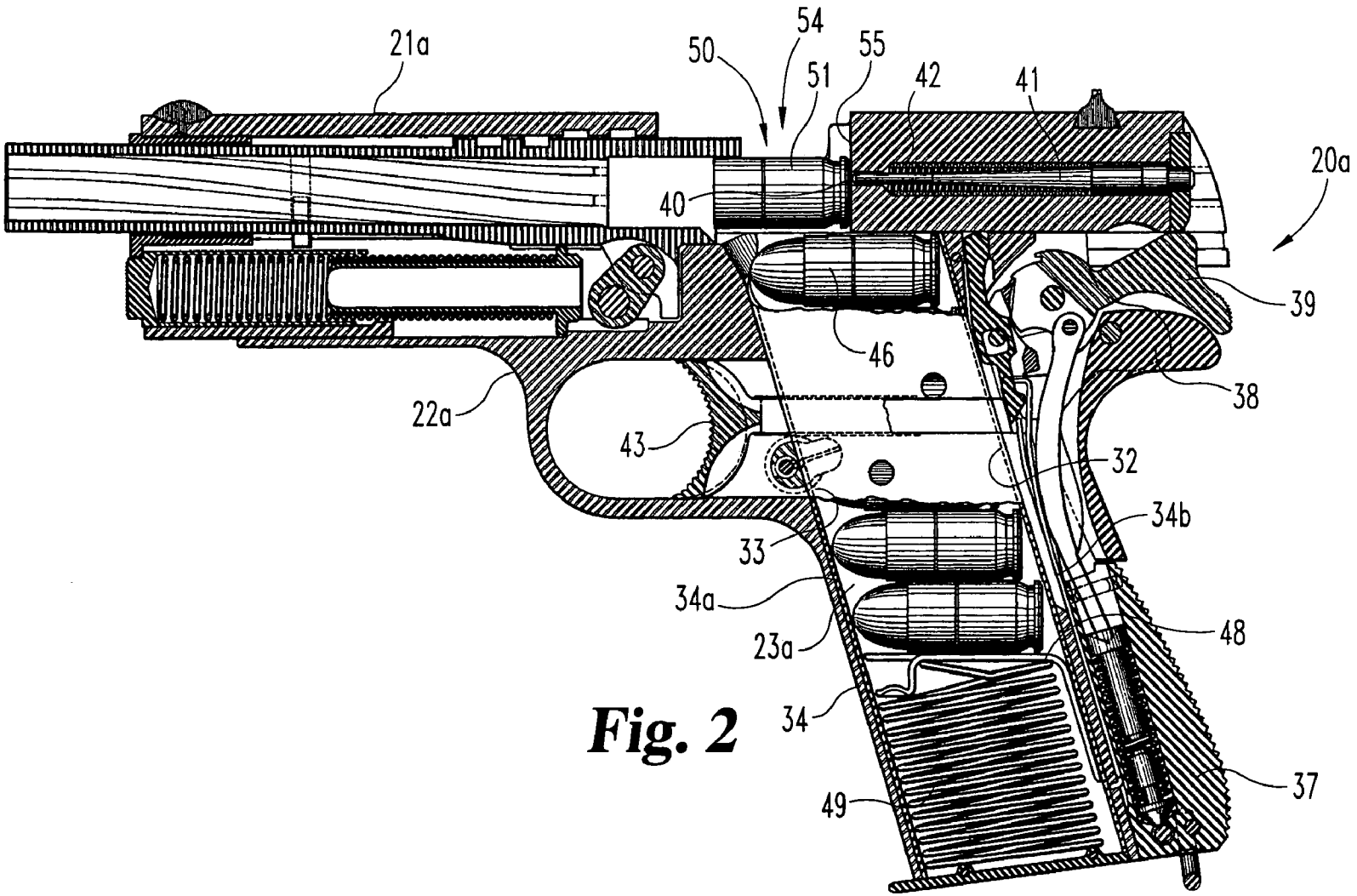
FIG. 2 is a side elevational view, in full section, of an M-1911 pistol, according to the present invention, illustrating a stage in the ejecting and chambering cycle, prior to case ejection.
Figure 3:
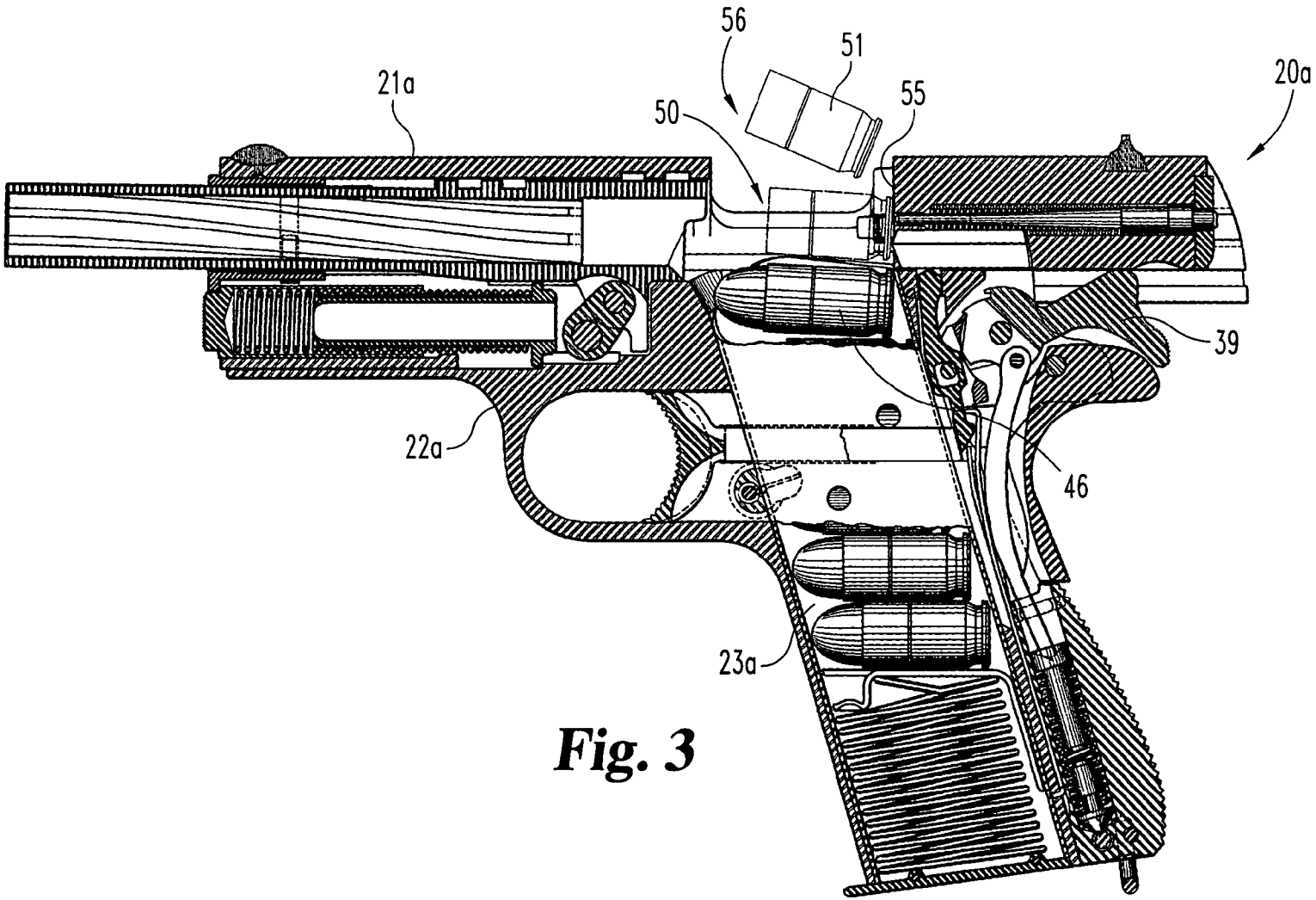
FIG. 3 is a side elevational view, in full section, of the FIG. 2 M-1911 pistol at a stage in the ejecting and chambering cycle, as case ejection begins.
Figure 4:
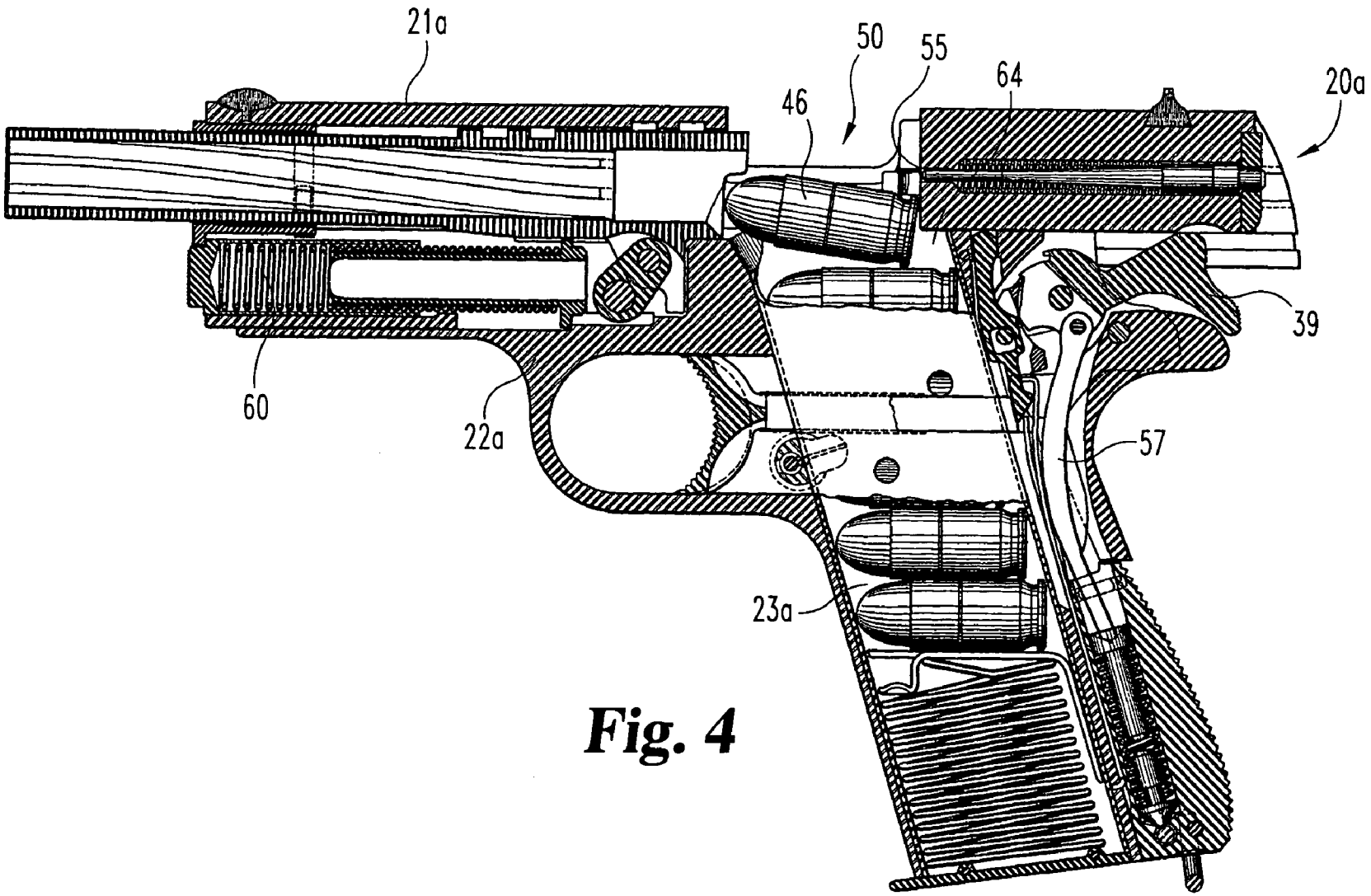
FIG. 4 is a side elevational view, in full section, of the FIG. 2 M-1911 pistol at a stage in the ejecting and chambering cycle, with case ejection completed.
Figure 5:
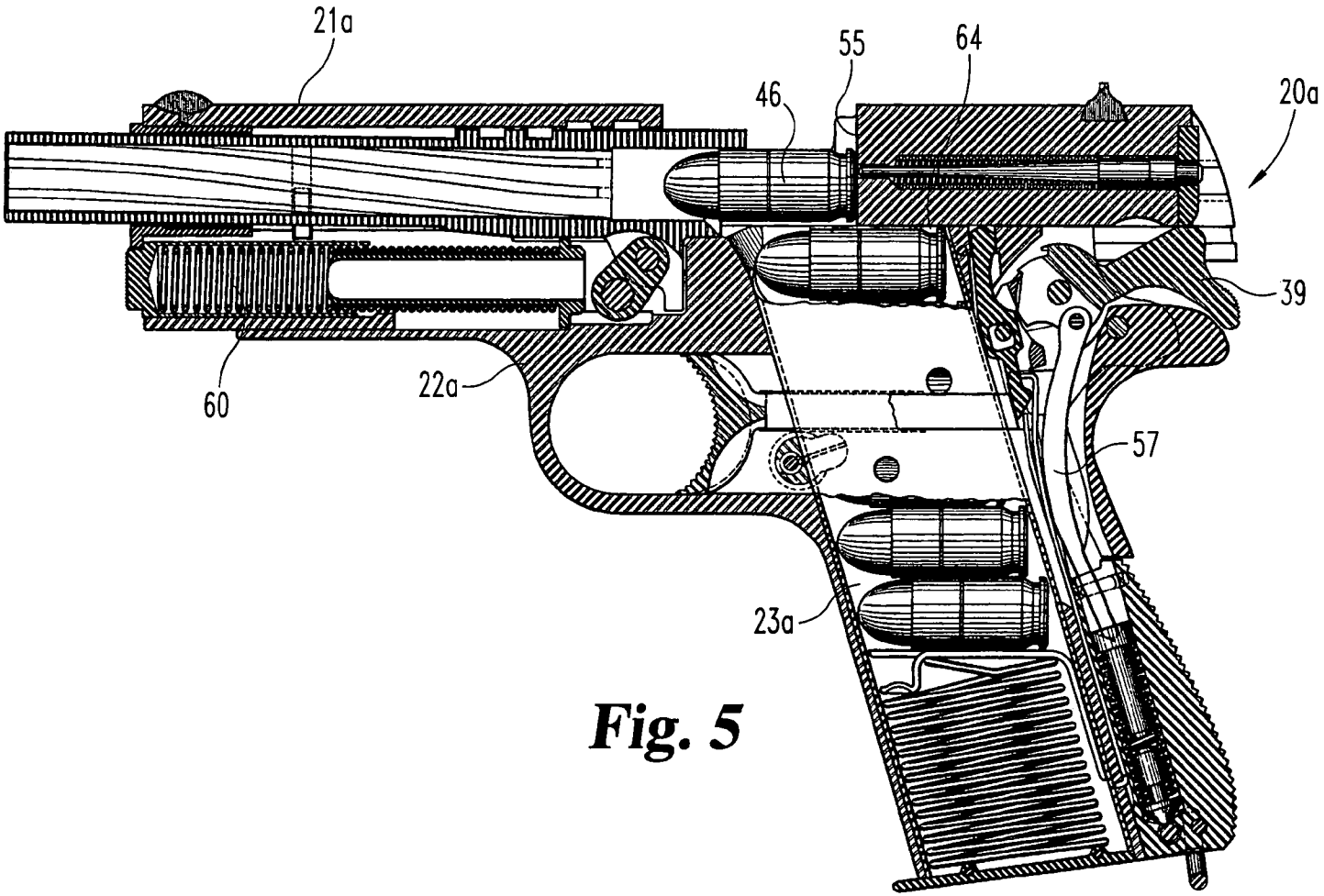
FIG. 5 is a side elevational view, in full section, of the FIG. 2 M-1911 pistol at a stage in the ejecting and chambering cycle, with the start of chambering a new round.
Figure 6:
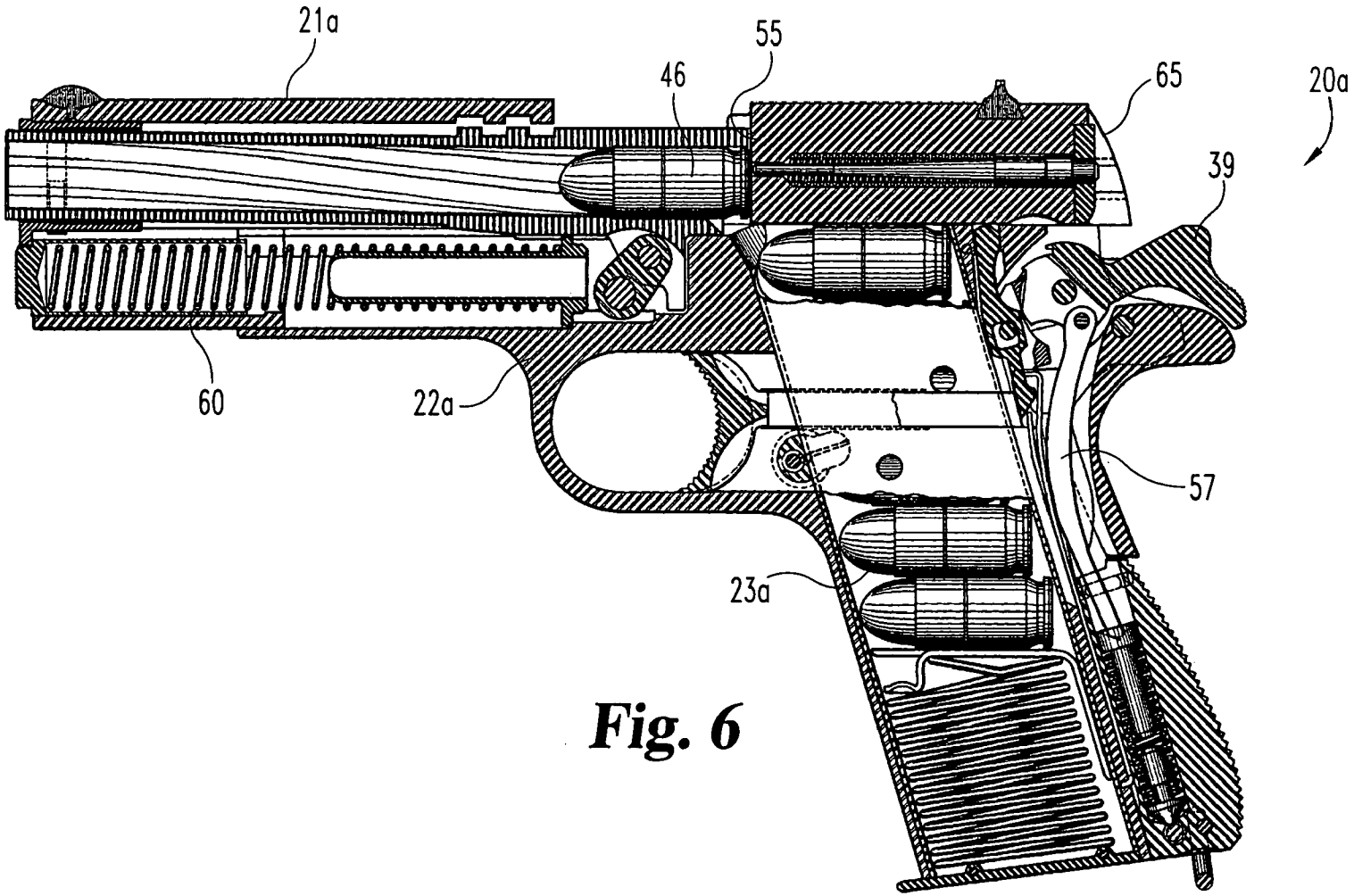
FIG. 6 is a side elevational view, in full section, of the FIG. 2 M-1911 pistol at a stage in the ejecting and chambering cycle, with the chambering of the new round completed.

Fired cartridge case 51 extraction occurs during rearward movement of the slide 21*a* and as the breech 54 begins to open as the barrel links down (see FIG. 2). The case 51 is held firmly against the breech face 55 by the extractor 40 as it is drawn back by the energy of the recoiling slide 21*a*. Continued rearward movement of the slide 21*a* then fully withdraws and thereby extracts the fired cartridge case 51 from the chamber 50. Ejection of the fired cartridge case 51 involves a pivoting action, upward and in a clockwise direction based on the orientation of the M-1911 pistol 20*a* in FIG. 3. This action frees the case 51 from the extractor 40 and ejects the case through the ejection port 56. The breech face 55 defines a proximal plane of the ejection port 56.

Cocking occurs as the hammer 39 is positioned to fire the next round by the continuing rearward movement of the slide 21*a*. The slide 21*a* rotates the hammer 39 back and the hammer strut 57 downward. This compresses the hammer spring and enables the sear, under sear spring pressure, to engage the hammer's full cock notch. Further rearward slide movement fully compresses the recoil spring 60 for the next firing cycle (see FIGS. 4, 5 and 6).

As would be understood, the speed and close dimensions of this sequence of cooperative steps requires a great deal of precision. Not only must the critical dimensions be very accurate, but the assembly and positioning of the component parts must be precise. One of the more critical areas involves the cooperative positioning of the breech face 55 relative to the ejection port 56 relative to the upper, open end 64 of the magazine 23*a*. There is very little margin for error or misalignment in these component parts in the prior art M-1911 pistol and the speed of ejection could result in the pistol jamming during the ejecting and chambering sequence or cycle. The most critical aspect relating to a possible jam of the M-1911 pistol seems to be slide travel to the rear and the positioning of the breech face 55 relative to the other cooperating parts participating in the various stages or steps of the ejecting and chambering process.

Considering the possibility for a jam with the prior art M-1911 pistol 20, and considering the dimensional downsizing or scaling down in order for the modified M-1911 pistol 20*a* to accommodate the .45 GAP cartridge, the present invention conceived of a way to accommodate the removal of material (approximately one-eighth inch shorter) in the slide 21*a* and provide an improvement relative to the likelihood of a jam. By reducing the risk or probability for a jam, the end result pistol 20*a* is more reliable. By removing the slice of material out of slide 21*a* at a location between the breech face 55 and the rear or proximal end 65 of slide 21*a*, the breech face 55 shifts farther to the rear, i.e., closer to the proximal end 65. This shift of the breech face 55 farther to the rear is an increase over what would otherwise occur if the material was removed from the slide at a different location.

Figure 7A:
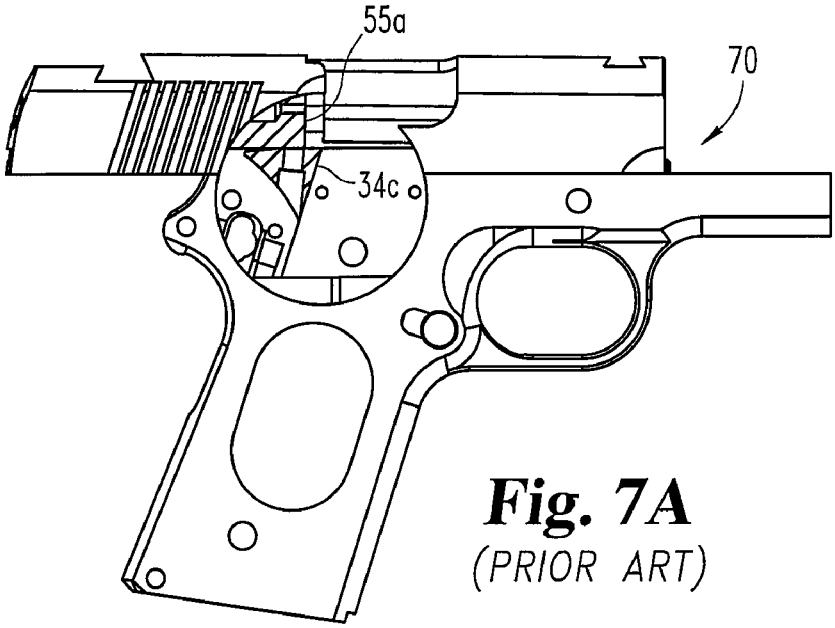
Fig. 7A (PRIOR ART)
FIG. 7A is a side elevational view, in partial section, of a compact M-1911 pistol prior to modification according to the present invention.

FIGS. 2-6 provide illustrations of the stages for ejection and chambering using a traditional M-1911 platform, as modified according to the present invention. In FIG. 7A, a slightly different style of M-1911 pistol is illustrated, prior to any modifications according to the present invention. The FIG. 7A style pistol 70 is referred to as an M-1911 officer's configuration (compact). The portion to note with regard to the FIG. 7A illustration is the distance of separation between breech face 55*a* and the rear wall 34*c* of the magazine well.

Figure 7B:
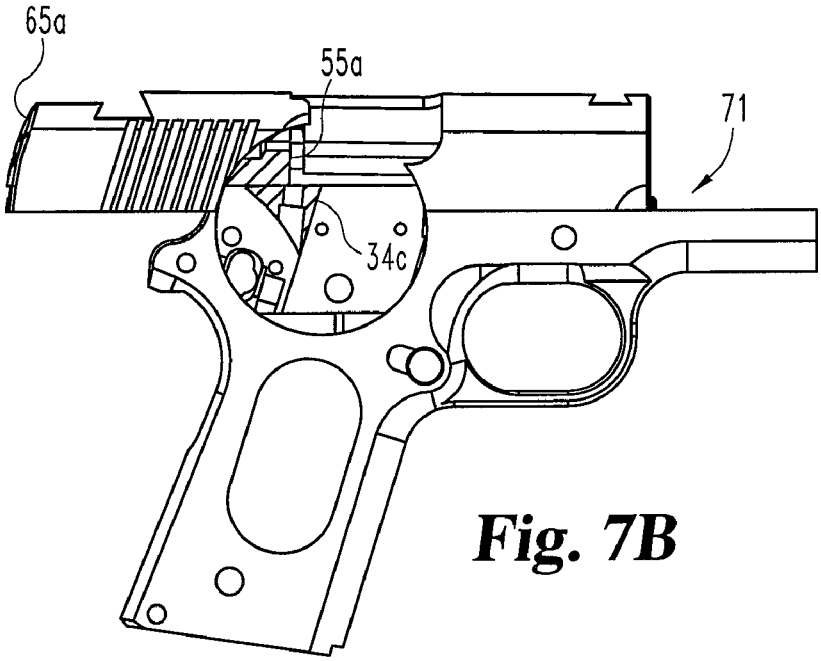
FIG. 7B is a side elevational view, in partial section, of a modified M-1911 pistol according to the present invention.

In FIG. 7B, the design modifications, according to the present invention, have been made to pistol 70, now pistol 71, and now the breech face 55*a* is farther to the rear of the pistol. This dimensional shift with regard to breech face 55*a* increases the distance between the breech face and rear wall 34*c* of the magazine well. This increased distance results in a longer dwell time for each firing and chambering cycle.

The dimensional shift of the breech face 55*a* farther to the rear of the slide creates a larger clearance space or an increase in the edge-to-edge distance so that there is less risk that the slide might interfere with either the ejecting or chambering stages. This dimensional shift in breech face 55*a* position, the result of removing an approximate one-eighth inch (0.123 inches) of material from the slide, between the breech face 55*a* and the proximal end 65*a* of the slide, gives the overall sequencing a split second longer in order to eject the fired cartridge case and chamber the next round from the magazine. While the increase in dwell time is quite small in terms of the actual time, it is significant, considering the overall cycle time. This increase in dwell time provides enough added dwell time to maintain the requisite clearance opening a little longer in order to eject the spent casing and chamber the new round. All of this is achieved while retaining full travel of the slide.

A further feature of the design modifications made to the prior M-1911 pistol in order to create M-1911 pistol 20*a* pertains to the receiver or frame. The same receiver is suitable for use with other ammo. The applicable family of shorter cartridges includes any cartridge that is shorter in length than the .45 ACP cartridge, such as, for example, 9 mm, .357 Sig and .40 S & W cartridges in addition to a .45 GAP cartridge. While each cartridge would still require its own magazine, the magazine well does not change. Additionally, the dimensional modification to the slide according to the present invention that creates an added dwell time by shifting the breech face farther to the rear is compatible with these other shorter cartridges within this "family". The corresponding slides can be modified in the same fashion.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A method of modifying a .45 ACP pistol for accepting a cartridge that is shorter than a .45 ACP cartridge, said .45 ACP pistol having a slide and a receiver defining a magazine well, said slide having a breech face and a proximal end, said magazine well having a front wall and spaced therefrom, by a first distance, a rear wall, said method comprising the following steps:

a.) reducing the first distance of separation between said front wall and said rear wall to a second distance of separation; and b.) reducing the distance between said breech face and said proximal end by an amount that is substantially the same as the difference between said first distance and said second distance.

2. The method of claim 1 wherein said difference between said first distance and said second distance approximately corresponds to an average cartridge length difference between a .45 ACP cartridge and a family of shorter cartridges.

3. The method of claim 2 wherein said family of shorter cartridges includes a .45 GAP, 9 mm, .357 Sig, and .40 S & W cartridges.

4. The method of claim 1 wherein said difference between said first distance and said second distance is approximately one-eighth inch.

5. The method of claim 1 wherein said .45 ACP pistol is an M-1911 pistol.

6. The method of claim 5 wherein said difference between said first distance and said second distance approximately corresponds to an average cartridge length difference between a .45 ACP cartridge and a family of shorter cartridges.

7. The method of claim 6 wherein said family of shorter cartridges includes a .45 GAP, 9 mm, .357 Sig, and .40 S & W cartridges.

8. A method of resizing a .45 ACP pistol for accepting a cartridge that is shorter than a .45 ACP cartridge, said .45 ACP pistol having a slide and a receiver defining a magazine well, the slide having a breech face and a proximal end, the magazine well having a front wall and spaced therefrom a rear wall, said method comprising the following steps:

a.) reducing the distance between said front wall and said rear wall by effectively moving the rear wall toward the front wall; and b.) shortening said slide by effectively removing a material slice from a portion of said slide, the width of said material slice being substantially equal to said rear wall movement, said material slice being taken out between said breech face and said proximal end, wherein the shortening of said slide is achieved by reducing the distance from said breech face to said proximal end.

9. The method of claim 8 wherein said rear wall movement of said magazine well is approximately one-eighth inch.

10. The method of claim 8 wherein said slide is shortened by approximately one-eighth inch.

11. The method of claim 8 wherein said .45 ACP pistol is an M-1911 pistol.

12. The method of claim 8 wherein said material slice corresponds to an average cartridge length difference between a .45 ACP cartridge and a family of shorter cartridges.

13. The method of claim 12 wherein said family of shorter cartridges includes a .45 GAP, 9 mm, .357 Sig, and .40 S & W cartridges.

14. A modified .45 ACP pistol constructed and arranged for accepting a cartridge that is shorter than a .45 ACP cartridge, said modified .45 ACP pistol comprising:

a receiver;

a slide assembled to said receiver and movable relative to said receiver, said slide including a breech face that defines a proximal plane of an ejection port;

a magazine well constructed and arranged to accept a magazine sized for said shorter cartridge, said shorter cartridge having a length and including a closed case end, said magazine well including a proximal wall; and said magazine well defining an upper opening, said upper opening including a proximal edge, wherein said proximal plane and said proximal edge are spaced apart at the time of cartridge case ejection by a distance that is larger than the corresponding distance of a non-modified .45 ACP pistol.

15. The .45 ACP pistol of claim 14 wherein said spaced apart distance is approximately one-eighth inch.

16. The .45 ACP pistol of claim 15 wherein said spaced apart distance corresponds to an increase in dwell time.

17. The .45 ACP pistol of claim 16 wherein said .45 ACP pistol is an M-1911 pistol.

18. A method of modifying a .45 ACP pistol, said pistol including a slide and a receiver defining a magazine well, said method comprising the following steps:

a.) reducing the size of the magazine well by moving a rear wall of the magazine well closer to a front wall of the magazine well; and b.) shortening the slide by moving a slide breech face closer to a slide proximal end.

* * * * *